US006026061A

United States Patent [19]

Heck

[11] Patent Number: 6,026,061

[45] Date of Patent: Feb. 15, 2000

[54] WRIST OR POCKET WATCH

[76] Inventor: Wolfgang Heck, Frankfurter Str. 125, D-34121 Kassel, Germany

[21] Appl. No.: 08/952,637

[22] PCT Filed: May 21, 1996

[86] PCT No.: PCT/DE96/00885

§ 371 Date: Nov. 21, 1997

§ 102(e) Date: Nov. 21, 1997

[87] PCT Pub. No.: WO96/37811

PCT Pub. Date: Nov. 28, 1996

[30] Foreign Application Priority Data

May 23, 1995 [DE] Germany ..... 295 08 52 U

[51] Int. Cl.[7] ..... G04F 8/00

[52] U.S. Cl. ..... 368/45; 368/3

[58] Field of Search ..... 368/45, 3, 221–230, 368/10

[56] References Cited

U.S. PATENT DOCUMENTS

| | | | |
|---|---|---|---|
| 4,128,949 | 12/1978 | Marason, Jr. et al. | 368/45 |
| 4,395,134 | 7/1983 | Luce | 368/3 |

FOREIGN PATENT DOCUMENTS

| | | | |
|---|---|---|---|
| 0254676 | 1/1988 | European Pat. Off. . | |
| 1237310 | 6/1960 | France . | |
| 1602236 | 10/1970 | France . | |
| 8124550 | 2/1983 | Germany . | |
| 54-14839 | 2/1979 | Japan | 368/3 |

*Primary Examiner*—Bernard Roskoski
*Attorney, Agent, or Firm*—James P. Hanrath

[57] ABSTRACT

A watch, especially a wrist, pocket watch or table clock, with a case containing a movement and means for showing the time, in which a game of skill fitted in the case can be played from outside.

11 Claims, 2 Drawing Sheets

WRIST OR POCKET WATCH

The invention relates to a watch, particularly to a wrist watch, a pocket watch or a table clock with a casing in which a clockwork and time indicating means are located.

Wrist or pocket watches are sufficiently known and very popular, since these watches can always be carried along near the body due to their small and compact design. Smaller table clocks having the approximate size of pocket watches are often placed onto desks or sideboards.

On longer journeys by bus, train or plane and/or during waiting periods, for example at the physician's, in authorities or the like, it would be pleasant to have an appropriate pastime to counteract upcoming boredom.

The object of the present invention is therefore to create a watch, particularly a wrist watch, a pocket watch or a table clock, which not only serves for reading the time but also for pastime during waiting periods.

The technical solution of this object is to develop a watch as mentioned above by accomodating a game of skill playable from outside into the casing.

A wrist watch, a pocket watch or a table clock designed according to this technical teaching has the advantage that a game of skill suitable for pastime is always carried along together with the watch and that it is thus always at hand on journeys and/or during waiting periods. As soon as the user of a watch according to the invention gets bored, he can kill the time with the game of skill.

In a particular embodiment of the invention the casing has a transparent protecting sheet under which the game of skill is accomodated and through which the course of the game can be observed. This protecting sheet can be made of glass, acrylic, plexiglass or of a transparent synthetic. A wire mesh or the like could also be used as protecting sheet.

A good visibility is thus achieved, so that the game of skill can be played without any hindrance.

The game of skill is preferably designed like a flipper. A movable body, e.g. a ball, a disk or the like is hereby launched out of a launching device and rolls or flies across a playing field before it lands in one of the reception pockets accomodated on the playing field. Usually, these reception pockets are valuated according to the difficulty encountered in aiming them, so that the skill of the player is involved when he tries to bring the ball or the disk for example into the desired reception pocket.

For the invention it is irrelevant whether the playing field has a horizontal, a vertical or an inbetween alignment. More important is that the player develops so much skill that he brings the movable body into the desired reception pocket.

The time indicators are preferably but not necessarily two traditional pointers. These pointers are accomodated in a depression or cavity of the playing field, whereas the pointers are located between the centre and the edge of the casing.

Further characteristics of the invention will be explained in the following description of an embodiment of the invention in connection with the claims and the drawing. The different characteristics can be realized each by its own or several together in embodiments of the invention.

The drawing shows a prefered embodiment of the invention.

Figure 1:
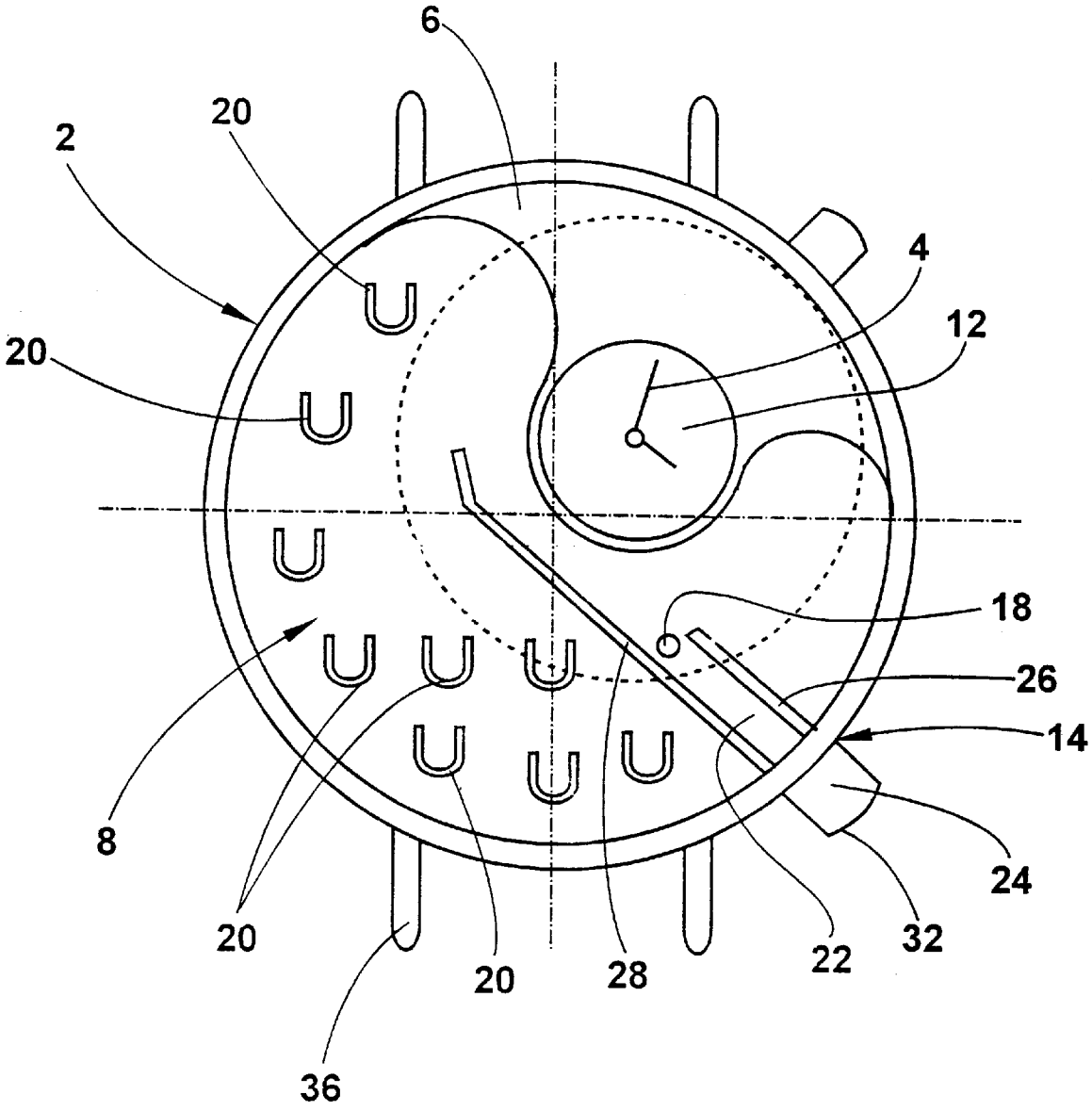
FIG. 1 shows a top view of an embodiment of a wrist watch according to the invention.

The different figures of the drawing are partly very schematic views of the wrist watch and are not to be understood true to scale.

Figure 2:
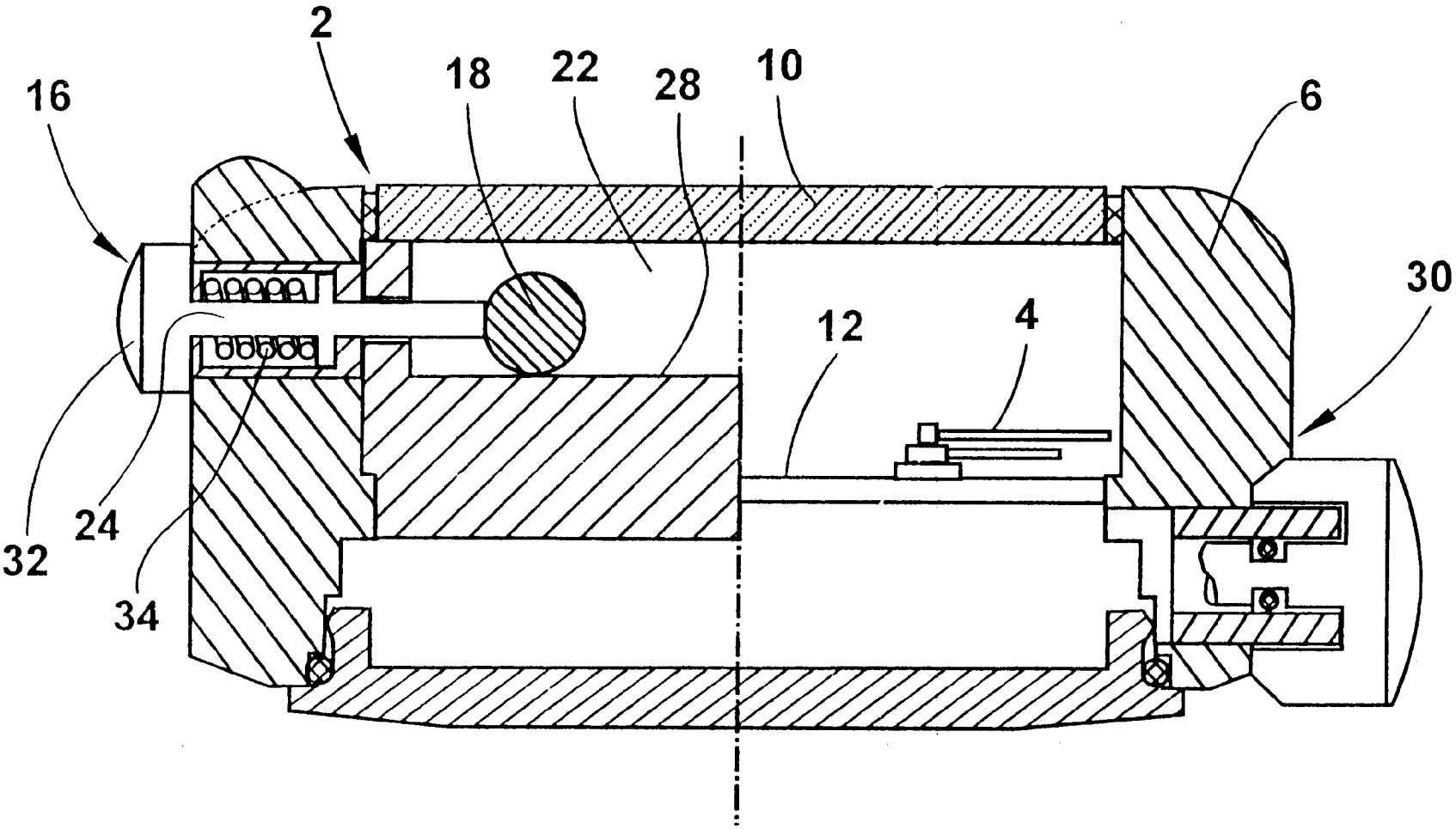
FIG. 2 shows a side view of the embodiment according to FIG. 1, in a section along the line II—II in FIG. 1.

The FIGS. 1 and 2 are showing a wrist watch 2 with commercial pointers 4 actuated by a not represented clockwork. In the casing 6 of the wrist watch 2, a flipper-like game of skill 8 is accomodated additionally to the clockwork and the pointers 4. The pointers 4 and the game of skill 8 are hereby accomodated side by side in such a way that they both can be seen simultaneously through a transparent protecting sheet 10 of the casing 6.

The watch itself with its face is much smaller than the casing 6 and is accomodated in an area between the centre and the edge of the casing 6 located in the upper right part of the casing 6.

The game of skill 8, having a playing field 14, a launching device 16 for launching a movable body, e.g. a ball 18, and a number of reception pockets 20 receiving the ball 18, is inserted into the remaining part of the casing 6. Other shapes of movable bodies could be round or polygonal disks, e.g. it could have the shape of a puck or of a ball-like, polygonal body, i.e. of a body having lots of faces or facets on its surface.

The launching device 16 is constituted of a launching base 22 and of a launching pin 24. The launching base 22 has a short 26 and a long side wall 28, both being adjacent to a small face 30 of the casing 6. The space between the short side wall 26 and the long side wall 28 is designed so that a ball 18 snuggly fits in. The side walls 26, 28 are arranged parallel to each other and are inclined so that a ball 18 lying close to the long side wall 28 rolls downwards to the small face 30 as soon as the casing 6 of the wrist watch 2 comes at least a little out of the horizontal plane. The long side wall 28 is curved in such a way that the launched ball rolls upwards along the side wall 28 and is guided into the upper area of the playing field 14.

From there, the ball falls down across the playing field 14 and hopefully lands in one of the reception pockets 20.

The launching device 16 has a launching pin for launching the ball 18, this launching pin extends on the small face 30 of the casing 6 from the launching base 22 through the casing 6 and ends in a cylindrical head 32 outside of the casing 6. As can be seen in FIG. 2, the launching pin 24 is held onto the casing 6 by means of a pressure coil spring 34.

To launch the ball 18 located in the launching base 22, the user pulls a little the launching pin 24 out of the casing 6 by overcoming the spring force of the pressure coil spring 34. As soon as the user lets go the launching pin 24, it jerks back into the casing 6, actuated by the pretensed pressure coil spring 34, and triggers the ball 18, which then jerks into the upper part of the playing field 14 alongside the long side wall 28 of the launching device 16. The user can hereby control the impulse given to the ball 18 by pulling the launching pin 24 more or less out of the casing 6, thus pretensing more or less the pressure coil spring 34. The ball 18 is then shot further or nearer into the upper part of the playing field 14.

Now, due to gravitation, the ball 18 falls down from the upper area of the playing field 14 and lands in one of the reception pockets 20 or falls between the reception pockets 20 onto the small face of the casing 6 in the lower area of the playing field 14.

The object of the game of skill 8 is to place the ball 18 in one of the reception pockets 20. The player can hereby influence the trajectory of the ball 18 by more or less pulling the launching pin 24 out of the casing 6 on one hand, on the other by swinging skillfully the playing field 14 and thus the casing 6 while the ball 18 is falling down from the upper area of the playing field 14.

It is hereby also possible to give each reception pocket 20 a specific valuation since all the reception pockets 20 cannot be reached by the ball 18 in the same manner.

In the embodiment according to FIG. 1 and 2, the casing is round, but it can as well be of an oval, triangular, square, rectangular or polygonal shape.

The protecting sheet 10 covering the playing field 14 as well as the digits 4 is made of acrylic, plexiglass, transparent synthetic or preferably of glass. Instead of the protecting sheet 10, a wire trellis or mesh could also be used, whereas the meshes have to be smaller than the ball 18.

In an embodiment not shown, the game of skill 8 is played with two or more balls 18, whereas the number of balls 18 should preferably not exceed the number of reception pockets 20 though.

The reception pockets 20 are distributed over the playing field 14, whereas each reception pocket 20 is given another valuation.

In another, not shown embodiment, the actual time is not indicated by pointers, but by digits, digitally or otherwise.

In still another, not shown embodiment, the protecting sheet 10 is in two pieces, whereas one part covers the playing field 14 and the other the pointers 4.

On the outside of the casing, holders 36 are provided for fastening the wristband. This watch equipped with the game of skill 8 could also be designed as a pocket watch. In this casing, the holders 36 should be substituted by holders for receiving a chain.

List of Numerals

2 wrist watch
4 pointers
6 casing
8 game of skill
10 protecting sheet
12 face
14 playing field
16 launching device
18 body
20 reception pocket
22 launching base
24 launching pin
26 short side wall
28 long side wall
30 small face
32 cylindrical head
34 pressure coil spring
36 holder

I claim:

1. A timepiece having a casing (6) in which a clockwork, time indicating means (4) and a mechanical game of skill (8) playable from outside are located, said casing including a substantially planar viewable surface having a first area portion wherein said time indicating means is disposed adjacent to but segregated from a second area portion wherein said mechanical game of skill (8) is disposed, said mechanical game of skill comprising a playing field (14), a movable body (18), and at least one reception pocket (20) receiving said movable body (18), characterized by said movable body being moved and set into play within said playing field by the triggering of a launching device (16).

2. A timepiece according to claim 1, characterized in that time indicating means are constituted by at least two pointers (4).

3. A timepiece according to claim 1, characterized in that said casing (6) is provided with a transparent protecting sheet (10) through which the course of the game is observable.

4. A timepiece according to claim 1, characterized in that said mechanical game of skill (8) has two or more movable bodies (18).

5. A timepiece according to claim 1, characterized in that more reception pockets (20) than movable bodies (18) are provided.

6. A timepiece according to claim 1, characterized in that said reception pockets (20) are distributed over said playing field (14).

7. A timepiece according to claim 1, characterized in that said launching device (16) further comprises a launching base (22) receiving said movable body (18) and a pretensable launching pin (24), whereas the body (18) located in the launching base (22) is movable by triggering said pretensable launching pin (24).

8. A timepiece according to claim 7, characterized in that the launching base (22) has a long side wall (28) guiding the body (18) towards the upper part of the playing field (14).

9. A timepiece according to claim 1, characterized in that the time indicating means (4) are arranged in a cavity of the playing field (14).

10. Watch, particularly a wrist watch, a pocket watch or a table clock according to at least one of the claims 4 to 9, characterized in that the time indicating means (4) are arranged in a cavity of the playing field (14).

11. A timepiece according to claim 1, characterized in that said movable body (18) comprises a ball or disk.

* * * * *